US006461392B1

(12) United States Patent
Kanakkanatt

(10) Patent No.: US 6,461,392 B1
(45) Date of Patent: Oct. 8, 2002

(54) CLEAR PLASTO-ELASTOMERIC MATERIAL AND PRODUCTS MADE THEREFROM

(75) Inventor: Sebastian V. Kanakkanatt, 2459 Audubon Rd., Akron, OH (US) 44320

(73) Assignee: Sebastian V. Kanakkanatt, Akron, OH (US)

( * ) Notice: Subject to any disclaimer, the term of this patent is extended or adjusted under 35 U.S.C. 154(b) by 0 days.

(21) Appl. No.: 09/397,971

(22) Filed: Sep. 16, 1999

Related U.S. Application Data

(60) Provisional application No. 60/100,668, filed on Sep. 16, 1998.

(51) Int. Cl.[7] ..... C10L 5/00
(52) U.S. Cl. ..... 44/275; 431/288
(58) Field of Search ..... 44/275; 431/288

(56) References Cited

U.S. PATENT DOCUMENTS

| | | | | |
|---|---|---|---|---|
| 3,615,389 A | | 10/1971 | Newberry | 96/1.1 |
| 3,645,705 A | | 2/1972 | Miller et al. | 431/288 |
| 3,741,711 A | | 6/1973 | Bryant | 431/125 |
| 3,819,392 A | | 6/1974 | Gunderman et al. | 44/7.5 |
| 5,132,355 A | | 7/1992 | Nahlovsky | 524/474 |
| 5,578,089 A | | 11/1996 | Elsamaloty | 44/275 |
| 5,789,089 A | | 8/1998 | Maki et al. | 428/623 |
| 5,879,694 A | * | 3/1999 | Morrison | 424/405 |
| 5,961,967 A | * | 10/1999 | Powell | 424/76.4 |

FOREIGN PATENT DOCUMENTS

| | | | |
|---|---|---|---|
| WO | 8800603 | 7/1987 | 53/2 |
| WO | 9927042 | * 6/1999 | |

* cited by examiner

*Primary Examiner*—Cephia D. Toomer
(74) *Attorney, Agent, or Firm*—Emerson & Skeriotis; John M. Skeriotis; Roger D. Emerson

(57) ABSTRACT

A clear plasto-elastomeric material comprising a thermoplastic, an elastomer or a copolymer or a blend thereof, mineral or vegetable oil, or a mixture thereof, and a fire retarding agent, is disclosed. This material has a combination of resiliency and shock absorption and is exceptionally hydro-slimy. Footwear made of this material has a high degree of comfort and shock absorption, slides made with the lining of this material are more efficient than water slides, and candles made with this material are freestanding, unbreakable, and have a very long burning time. The candles have been enhanced with photochromic, thermochromic, iridescent, fluorescent, and phosphorescent materials and with combinations thereof.

6 Claims, No Drawings

CLEAR PLASTO-ELASTOMERIC MATERIAL AND PRODUCTS MADE THEREFROM

This application claims priority to an U.S. Provisional patent application, Ser. No. 60/100,668, entitled UNBREAKABLE CANDLE, filed on Sep. 16, 1998.

I. FIELD OF THE INVENTION

This invention relates to the art of plastics and elastomers, and more particularly to the art of a clear, resilient plasto-elastomeric material.

II. BACKGROUND OF THE INVENTION

Soft gel materials used in container candles have been reported in U.S. Pat. No. 5,789,089, by Elasamatory. This material is unsuitable for use as a freestanding candle, or in shoe soles, or in any of the other uses for which the present invention is ideal.

A characteristic transparent candle has been disclosed is U.S. Pat. No. 3,819,342 (the '342 patent). This candle comprises a thermoplastic polyamide resin and a flammable solvent selected from the group consisting of unsaturated fatty acids with polyhydric alcohols, and mixtures thereof. This candle suffers from the drawback of potential flaring, resulting from the separation of oil from the candle forming a top layer.

U.S. Pat. No. 3,615,389 ("the '389 Patent"), discloses another clear candle that is chemically similar to the device of the '342 Patent. The composition comprises a thermoplastic polyamide resin formed from linoleic acid, polymerized with a polyamide alkolamide or alkanol, and stearic acid. This composition allegedly alleviates syneresis. But U.S. Pat. No. 5,578,089 claims to have tested the above compositions and found that separation was a consistent problem in '389 and '342 candles. The '389 patent also claims the optional addition of ionic surface agents that prevent "blooming" or fogging, which result in the loss of transparency. Although this may be helpful, it does not eliminate cloudiness.

U.S. Pat. No. 3,645,705 ("the '705 patent") discloses a transparent candle material comprising a straight chain aliphatic amide with white mineral oil and alcohol. There is also a methyl ester added for hardness. The '705 patent, however, is similar to the '342 and '389 patents, in that it suffers from the same structural and functional problems.

U.S. Pat. No. 3,741,711 ("the '711 patent") appears to disclose a clear, undyed, and unpigmented wax band "candle." However, the invention is a reusable "candle holder" and not a "candle."

III. SUMMARY OF THE INVENTION

This invention relates to a plasto-elastomeric material comprising two or more of, but not limited to, the following: (a) thermoplastic; (b) mineral oil; (c) vegetable oil; (d) rubber; (e) thermoplastic olefin; (f) thermoplastic elastomer; (g) copolymer; and (h) blends of two or more of the above. Some of the exceptional properties of this material are the following: (1) Clarity; (2) resiliency; (3) shock absorption; (4) resilio-damping balance; (5) high flash point; (6) burns leaving no ash at high temperatures; and (7) hydro-sliminess not affected by applied pressure.

The above properties, as well as others, render the plasto-elastomeric material of this invention highly applicable for use in the following:

i. Insoles and soles of shoes;
ii. water slide replacement surfaces;
iii. mold making;
iv. unbreakable, free standing candies; and,
v. medical devices such as catheters, tubes in general, flexible implants and the like.

One object of the present invention is to form an unbreakable, transparent, non-flaring, non-blooming candle that burns without coking or dripping.

Another object of the present invention is to exclude the use of polyamides or nitrogen-containing polymers that are known, on burning, to exude hazardous byproducts containing oxides of nitrogen.

Yet another object of the present invention is to produce an extremely slow burning candle. The candle made from the composition of this invention will take more than five times longer to burn the same amount of material with a similar size flame as a known candle.

Still another object of the present invention is to form a candle that is longer than wax- based and polyamide-resin-based candles.

Another object of the present invention is to mold a candle which is either clear, meaning uncolored, or dyed with organic pigments, which maintain the transparency of the candle in the colored state. These pigments are not sensitive to light, nor do they decrease the clarity of the candle, the size of the flame during burning, nor do they cause any flare. The inert nature of the composition in this invention makes it inactive to the dyes or pigments at the elevated temperatures of the molten material.

A further object of the present invention is to prevent age-induced brittleness, which is encountered in wax-based and polyamide-resin-based candles.

Another object of the present invention is to make transparent candle material that does not need a container to hold it, as in the case of presently available gel candles. The candles made from the present composition are freestanding, unbreakable, and free of a container.

One advantage of the present invention is its thermal reversibility. Unlike polyamide-resin-based candles, the composition in the present invention is remeltable and reusable any number of times. This feature of the present invention allows the mixing of color(s), fragrances, etc. before molding as well as after molding and re-melting. This recycling capability minimizes the waste and environmental problem associated with solid waste disposal.

Another advantage of the present invention is the elimination of syneresis/blooming resulting from excessive cross-linking, which is a serious problem in polyamide resin based candles. By eliminating any chemical cross-linking, and minimizing the so-called physical cross-linking, the oil exuding problem is overcome in the present invention.

Yet another advantage of the present invention is that the plasto-elastomeric material has exceptional balance of resilience and damping properties, which makes the material ideal for soles of shoes, rendering a high level of comfort to the wearer.

Still another advantage of the present invention is the high flash point that makes it suitable for use in making clear, free-standing, non-flashing candles, and for use as a high resolution mold polymer in the jewelry industry.

Another advantage of the present invention is that the burning emission, and the solid melting states are all non-toxic as well as nearly soot-free. At high temperatures the composite material leaves no ash, making it ideal for use as a mold polymer. While rubber used as a mold rubber or mold polymer produces toxic emissions when it is burnt from the mold, the plasto-elastomeric material in the present invention, being made of hydrogen and carbon only, creates no toxic fumes during complete combustion.

Yet another advantage of the present invention is that the material has zero friction when two slabs of the material contact each other with a small amount of water between the slabs. The coefficient of friction between the two slabs, with moisture in between, is lower than two Teflon slabs under similar conditions. This ultra low, or zero, friction remains the same no matter what pressure or load is applied to the slab. This unusual feature of the material is referred to as 'hydro-sliminess.' This hydro-sliminess of the plasto-elastomer is not thixo-limiting. On the other hand, with greater applied pressure and/or increased load on the top layer, the water-induced slippery property only increases. Thus this property makes it applicable as a surface for slides, similar to the water-slides, with the advantages that the volume of water used is small and the steepness of the sliding slope is drastically decreased.

The above aspects are achieved in accordance with the first aspect of the present invention which is a candle comprising an unbreakable, free-standing, clear body without a container, at least one wick, which may be introduced before the molten mass solidifies or after the candle body is made by a needle threaded with the wick. The body is a clear, strong, free-standing gel comprising 60 to 90 weight % of liquid paraffin wax, mineral oil, vegetable oil, polyethylene glycols and methoxypolyethylene glycols, such as those sold under the tradename Carbowax, and combinations thereof, 10 to 40 weight % of thermoplastic elastomers having plastic and elastomeric phases, chemically bonded together, as in Kratons™, manufactured by Shell Chemical Co., or thermoplastic elastomers in which plastic and elastomeric phases are physically blended, as in the case of Santoprene™ manufactured by Advanced Elastomer Systems, or polymeric alloys made by blending selected plastics such as polystyrene, polyethylene, polypropylene, etc. and elastomers such as polybutadiene, cis-polyisoprene, ethylene-propylene-diene rubber, styrene-butadiene rubber, natural rubber, etc. or combinations thereof.

IV. DESCRIPTION OF THE PREFERRED EMBODIMENT

The preferred embodiments of the present invention will now be described in greater detail below.

A candle body material is made as follows: 20.1 to 50% of a polymer, which is nitrogen free, thermoplastic, and elastomeric above the glass transition temperature of the rubber phase. This polymer, or polymer system, must have two phases at the operating temperature. That means it will have a plastic phase that has a very high glass transition temperature and the rubbery (elastomeric) phase will have a very low glass transition temperature. This may be realizable in a single polymer that has plastic blocks and elastomeric blocks in a single molecular chain as in block copolymers of the diblock, triblock, or multiblock copolymers. In multiblock copolymers, one type of block is made of monomers such as styrene, which yields the plastic phase, and the other type of block is made of monomers such as butadiene, which yield the elastomeric phase. These blocks are chemically bonded to give the thermoplastic elastomer such as Kratons™, manufactured by Shell Chemical Company. It may also be realizable in a physical blend of the two, namely, the plastic and the elastomer, giving two phases in the blend. The relative proportions of the two will determine which would be the continuous phase and which would be the discrete phase. A relatively higher proportion of the plastic component will give a blend with a plastic continuous phase yielding a thermoplastic elastomer, while a higher relative proportion of the elastomer will give plastic reinforced rubber. These blends are available from Advanced Elastomer Systems and the trade name is Santoprene™.

Another way of making the polymer system for this invention is by melting select plastics, such as polystyrene, and select elastomers, such as polybutadiene, and creating a polymer alloy with the desired properties of a thermoplastic elastomer. The molecular weight of the plastic component may be from 5,000 to 100,000 and that of the elastomeric component may be from 10,000 to 500,000. The alloy may be made in relative proportions of plastic to elastomer from 1:99 to 99:1, the preferred range being from 40:60 to 60:40. The second component of the composition is an oil, extender, or a plasticizer selected from: paraffinic oils, naphthenic oils, polyethylene glycols and methoxypolyethylene glycols, such as those sold under the tradename Carbowax , mineral oils, vegetable oils, liquid long chain aliphatic alcohols, liquid long chain aliphatic acids, esters of aliphatic alcohols and acids, plasticizers (other than phthalates), or combinations thereof.

The third ingredient is selected from glycerides of long chain acids, such as lauric acid, myristic acid, or stearic acid. The fourth and additional ingredients are 1) dyes which are temperature stable, light stable, and oxidation stable; 2) thermochromic dyes, which change color with the change of temperature; 3) photochromic dyes, which are sensitive to UV and visible light radiations, resulting in a color change; 4) phosphorescent pigments, which glow in the dark after having been activated by UV or visible light; 5) fluorescent pigments which glow in the day; and 6) scents and fragrances.

The third ingredient is preferably selected from, but not limited to, chlorinated paraffins, chlorinated hydrocarbons, and ammonium polyphosphate-4 triaryl phosphates. Fire-retardants are added in extremely low quantities to minimize or eliminate the flaring hazard, without sacrificing the normal burning or transparency of the candle.

Most, if not all, gel candles flare frequently. This is because of the high content of oil, which always blooms to the surface. This oil makes anything that touches the candle greasy and oily. In this invention, the polymer contains a special organic, non-poisonous, fire retardant that drastically minimizes, if not eliminates, the flaring problem. The balanced oil-polymer fire retardant formula, disclosed in this invention, eliminates the threefold problem in gel candles, namely, flaring, oil leaching, and collapsing, all without a container. The specially-made fire-retardant eliminates the flaring hazard without interfering with the normal burning of the candle or reducing the clarity or transparency of the candle.

EXAMPLE 1

2.1 lbs. of ethylene-nonene copolymer, manufactured by Advanced Elastomer Systems under their tradename, Engage™, 0.01 lb. of chlorinated paraffin manufactured, by Dover Chemicals under the trade name Chlorez™, and 7.9 lbs. of naphthenic oil manufactured by Penreco, under the tradename Drakeol™, are weighed out in an aluminum tray and heated in a preheated oven at 316° F. for 4 hours. At the end of this period the two components are blended and gelled together to form a clear homogenous mass. This homogenous mass is taken out of the oven and cooled at room temperature for about 6 hours. It is now ready for remelting and pouring into candle or other molds.

EXAMPLE 2

3.0 lbs. of ethylene-butadiene copolymer, manufactured by Shell Oil Company under the tradename Kraton™, 0.01 lb. of Chlorez™, and 7.00 lbs. of paraffinic oil, manufactured by Penreco under the tradename Drakeol™, are weighed out in an aluminum tray and heated in a preheated oven at 296° F. for 4 hours. At the end of this period the two components are blended and gelled together to form a clear homogenous mass. This homogenous mass is taken out of the oven and cooled to the room temperature for about 6 hours. It is now ready for remelting and pouring into the candle or other molds.

EXAMPLE 3

The product, as in Example 1 or Example 2, is remelted at 250° F. 5 lbs. of the molten material is mixed with 0.052 lb. of a foaming agent and the temperature is raised to 275° F. to start the foaming action. When the foaming agent is completely decomposed, the foamed material is chilled in order to stop the foaming action. Fire retardants, colors, fragrances, and other additives are used for further enhancing the product's properties.

While the invention has been described in conjunction with specified embodiments, it is evident that many alternatives, modifications, and variations will be apparent to those skilled in the art in light of the forgoing descriptions and examples, and without deviating from the contemplated scope of the present invention. Accordingly, it is intended to embrace all such alternatives, modifications, and variations which fall within the spirit and scope of the appended claims.

Having thus described the invention, it is now claimed:

1. A candle comprising:

at least one wick;

a free-standing gel body comprising:
at least one thermoplastic elastomer;
at least one thermoplastic; and
at least one elastomer wherein the ratio of at least one thermoplastic to at least one elastomer is 1:99.

2. The candle of claim 1 further comprising at least one mineral oil.

3. The candle of claim 1 further comprising at least one vegetable oil.

4. A candle comprising:

at least one wick;

a free-standing gel body comprising:
at least one thermoplastic elastomer;
at least one thermoplastic; and
at least one elastomer wherein the ratio of at least one thermoplastic to at least one elastomer is 99:1.

5. The candle of claim 1 wherein the ratio of at least one thermoplastic to at least one elastomer is 60:40.

6. The candle of claim 1 wherein the ratio of at least one thermoplastic to at least one elastomer is 40:60.

* * * * *